US006752063B2

(12) United States Patent
Panek et al.

(10) Patent No.: US 6,752,063 B2
(45) Date of Patent: Jun. 22, 2004

(54) MULTIPLE CELL AMMUNITION CRADLE

(75) Inventors: Alan W. Panek, Andover, MN (US); John P. Hinsverk, Fridley, MN (US); Lowell R. Larson, Andover, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 10/285,307

(22) Filed: Oct. 31, 2002

(65) Prior Publication Data

US 2004/0083881 A1 May 6, 2004

(51) Int. Cl.[7] ..... F41A 9/39
(52) U.S. Cl. ..... 89/46; 89/45
(58) Field of Search ..... 89/46, 45, 47, 89/35.03, 33.05

(56) References Cited

U.S. PATENT DOCUMENTS

| | | | | | |
|---|---|---|---|---|---|
| 2,770,170 | A | * | 11/1956 | Franson | 89/46 |
| 3,106,866 | A | * | 10/1963 | Klapdohr et al. | 89/45 |
| 3,122,967 | A | | 3/1964 | Johnson et al. | |
| 3,218,930 | A | | 11/1965 | Girouard et al. | |
| 3,724,324 | A | | 4/1973 | Zielinski | 89/36 |
| 3,884,119 | A | * | 5/1975 | Zouck | 89/45 |
| 4,092,900 | A | | 6/1978 | Hottinger et al. | 89/33 |
| 4,313,363 | A | | 2/1982 | Schreckenberg | 89/46 |
| 4,398,447 | A | | 8/1983 | Harris et al. | 89/46 |
| 4,401,008 | A | | 8/1983 | Walker, Jr. | 89/33 |
| 4,429,616 | A | | 2/1984 | Grosser | 89/36 |
| 4,457,209 | A | | 7/1984 | Scheurich et al. | 89/45 |
| 4,481,862 | A | | 11/1984 | Wiethoff et al. | 89/46 |
| 4,730,536 | A | | 3/1988 | Nordmann | 89/45 |
| 4,823,675 | A | * | 4/1989 | Schiele et al. | 89/46 |
| 4,838,144 | A | | 6/1989 | Bierwirth et al. | 89/45 |
| 4,919,038 | A | * | 4/1990 | Kaustrater et al. | 89/46 |
| 4,961,367 | A | * | 10/1990 | Lindberg | 89/33.04 |
| 5,177,319 | A | * | 1/1993 | Grimm | 89/47 |
| 5,196,643 | A | * | 3/1993 | Jorg et al. | 89/46 |
| 5,335,580 | A | * | 8/1994 | Mouterde et al. | 89/47 |
| 5,440,966 | A | * | 8/1995 | Tellander et al. | 89/46 |
| 5,773,747 | A | | 6/1998 | Tellander et al. | 89/47 |
| 5,811,721 | A | | 9/1998 | Anderson et al. | 89/45 |
| 5,880,395 | A | | 3/1999 | Krumm et al. | 89/46 |
| 6,679,159 | B1 | * | 1/2004 | Hullett | 89/45 |
| 2002/0144589 | A1 | * | 10/2002 | Grange et al. | 89/45 |

* cited by examiner

*Primary Examiner*—Charles T. Jordan
*Assistant Examiner*—John W. Zerr
(74) *Attorney, Agent, or Firm*—Patterson, Thuente, Skaar & Christensen, P.A.

(57) ABSTRACT

A multiple cell ammunition cradle system for a weapon wherein the rate of ammunition transfer and the consequent rate of fire of the weapon is independent of the azimuth angle of the weapon. The system generally includes a cradle having a rotor with a plurality of cells formed therein. The cradle may be disposed in a charging position and a loading position. When in the charging position, each of the cells is controllably, selectively alignable with an ammunition hoist to receive an ammunition component in each cell. When the cradle is pivoted into the loading position, the rotor may be positioned so that each of the cells is alignable with the barrel of the weapon so that the ammunition component may be loaded into the weapon and fired.

22 Claims, 5 Drawing Sheets

MULTIPLE CELL AMMUNITION CRADLE

FIELD OF THE INVENTION

This invention pertains to systems for transferring ammunition for weapons, and more specifically, it pertains to an ammunition cradle for a weapon mounted on a rotatable carriage.

BACKGROUND OF THE INVENTION

Ships have been used as weapons platforms for centuries. In modem times, warships mounting major caliber guns are often used for heavy bombardment of targets on shore. The emphasis on design of warships in the past has often focused on mounting a relatively large number of guns on a single platform due to the high cost involved with building large ships capable of supporting even one major caliber gun. It was possible for such a ship to maintain a high rate of fire overall due to the large number of weapons.

Warships of today are often used to support limited engagements in which it is necessary for the weapons to have pinpoint accuracy in order to minimize collateral damage to non-military targets, and to provide close fire support for troops on the ground. Due to the relatively high cost of weapons with the desired degree of accuracy, it is desirable to develop weapons with a high rate of fire so as to minimize the need for large numbers of weapons on a single platform.

Ammunition rounds for major caliber weapons normally comprise a projectile, a propellant charge and a primer or other igniting means. Separate ammunition is a term that refers to systems in which the three components are separately provided and are combined at the weapon. The term semi-fixed ammunition refers to systems in which the primer and the propellant are packaged together, and the term fixed ammunition refers to systems in which all three components are packaged together. Ammunition rounds for major caliber guns are typically of the separate or semi-fixed ammunition type. For the purposes of this application, the term ammunition round is used interchangeably to refer to complete ammunition rounds as well as any separate portion thereof.

Guns are usually mounted in turrets or carriages on a warship, and the barrel of the gun is generally controllable in elevation as well as in azimuth, which is referred to as train. The term elevation axis refers to the axis about which the gun rotates in elevation, and the term train axis refers to the axis about which the gun rotates in azimuth. Ammunition rounds are normally supplied to the gun carriages from magazines located deep in the hull through one or more ammunition handling systems. Such ammunition handling systems are well known. Examples of previous ammunition handling systems are described in U.S. Pat. No. 3,218,930 to Girouard, et al., U.S. Pat. No. 3,122,967 to Johnson, et al., U.S. Pat. No. 4,457,209 to Scheurich, et al., and U.S. Pat. No. 4,481,862 to Wiethoff, et al., each of which is hereby fully incorporated herein by reference.

Historically, loading of major caliber guns, particularly in a warship has been accomplished by either an "on-axis" or an "off-axis" loading method. In the on-axis method, a gun cradle mounted so as to pivot about the elevation axis of the gun is aligned with a vertical ammunition hoist disposed along the train axis of the gun to allow a single ammunition round to be transferred to the cradle. The cradle is then pivoted upward into alignment with the barrel so that the ammunition round may be rammed into the breech and barrel to be fired. Such "on-axis" systems offer the advantage of a simple mechanism and loading motion. A disadvantage of standard on-axis loading systems, however, is that only one hoist and cradle may be used per barrel, thus limiting the Firing rate of the gun. Moreover, if semi-fixed or separate ammunition is used, the ammunition components must be loaded into the ammunition hoist in sequential fashion, and more than one pivoting cycle of the cradle may be necessary to transfer the multiple components of a single round to the breech of the gun for firing.

Another method of loading is known as "off-axis loading", meaning that the ammunition rounds arc supplied vertically to a pivoting cradle from a hoist located along an axis offset from the train axis of the gun. A carrier and various mechanisms are used to horizontally translate the ammunition round and orient it for alignment with the barrel.

Off-axis loading is desirable in that it allows a system to use multiple hoists and multiple gun cradles, thereby improving the rate of fire from that achievable with an on-axis loading system. Since the azimuth of the gun breech and cradle varies with the azimuth of the gun in an off-axis loading system, however, a complex mechanism is required to receive the ammunition round from the off-axis hoist, transfer it the distance from the hoist to the cradle of the gun, and align it with the breech so it can be loaded into the gun. The necessity to "follow" the train motion of the gun makes the firing rate of the gun dependant on the azimuth of the gun, and thus can cause a significant negative impact on the rate of fire at certain azimuth angles. Moreover, the modem tendency is toward increased use of precision guided munitions in major caliber weapons. Known off-axis ammunition handling systems are not well suited to handle the increased length of these longer ammunition rounds.

What is needed is an ammunition handling system for loading a weapon that enables a uniform, rapid rate of fire and that is suited to handling ammunition rounds of increased length.

SUMMARY OF THE INVENTION

The present invention is a multiple cell ammunition cradle for a weapon that enables a uniform, rapid rate of fire, independent of the relative azimuthal orientation of the weapon, and that is suited to handling ammunition rounds of increased length. In a preferred embodiment, the invention includes a cradle having a rotor with a plurality of cells formed therein. The cradle is pivotable about the elevation axis of the weapon, and may be disposed in a charging position and a loading position. When in the charging position, each of the cells is controllably, selectively alignable, by means of the rotor, with an ammunition hoist to receive an ammunition round or component in each cell. When the cradle is pivoted into the loading position, the rotor may be positioned so that each of the cells is alignable with the breech and barrel of the weapon so that the ammunition round or component may be loaded into the weapon and fired. The present invention could also be used for handling and disposing of a spent cartridge case.

The ammunition cradle of the present invention is suitable for handling any type of ammunition including separate, semi-fixed, or fixed ammunition, and may also be used to handle rocket propelled or precision guided munitions, which may be of increased length relative to a standard major caliber round. It is anticipated that the present invention may provide the benefits of reduced gun system size, and complexity through the elimination of the complex mechanisms used in prior art systems. It is anticipated that the ammunition cradle, when used with a weapon, may enable firing rates of ten rounds per minute and above.

Thus, the invention may be characterized in one embodiment as a multiple cell ammunition cradle system for a weapon having a carriage and a barrel. The system comprises at least one ammunition hoist and a cradle operably coupled to the carriage. The cradle is selectively positionable in a charging position and a loading position. The cradle has a carrier, which may be a rotor with a plurality of cells, each cell adapted to receive a component of an ammunition round. The rotor is rotatable about a rotor axis, and is controllably positionable so that each cell is selectively alignable with the ammunition hoist when the cradle is positioned in the charging position and so that each cell is selectively alignable with the barrel when the cradle is positioned in the loading position.

The invention may also be characterized as a method for sequentially loading and firing a weapon having a barrel disposed along a loading axis, the weapon being mounted on a carriage. The method comprises the steps of: providing an ammunition transfer system comprising a plurality of ammunition hoists and a cradle operably coupled to the carriage, the cradle having a rotor with a plurality of cells adapted to receive an ammunition component, the rotor being controllably positionable so that each cell is selectively alignable with the ammunition hoists to receive the ammunition component and selectively alignable with the barrel to load the ammunition component into the gun; loading an ammunition component into each of the plurality of cells from the ammunition hoists; positioning the cradle so that the cradle is disposed along the loading axis; rotating and positioning the rotor so that one of the plurality of cells is axially aligned with the barrel; and ramming the ammunition component from the aligned cell into the barrel.

The invention may also be characterized as a weapon and ammunition loading system. The weapon and system has a carriage, a barrel mounted on the carriage, at least one ammunition hoist for supplying ammunition components, and a cradle having a carrier with a plurality of cells. The cradle is controllably positionable in a charging position and a loading position. The carrier may be arranged so that each cell is alignable with the ammunition hoist for receiving the ammunition component when the cradle is in the charging position and alignable with the barrel for transferring the ammunition component for loading into the weapon when the cradle is in the loading position.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1:
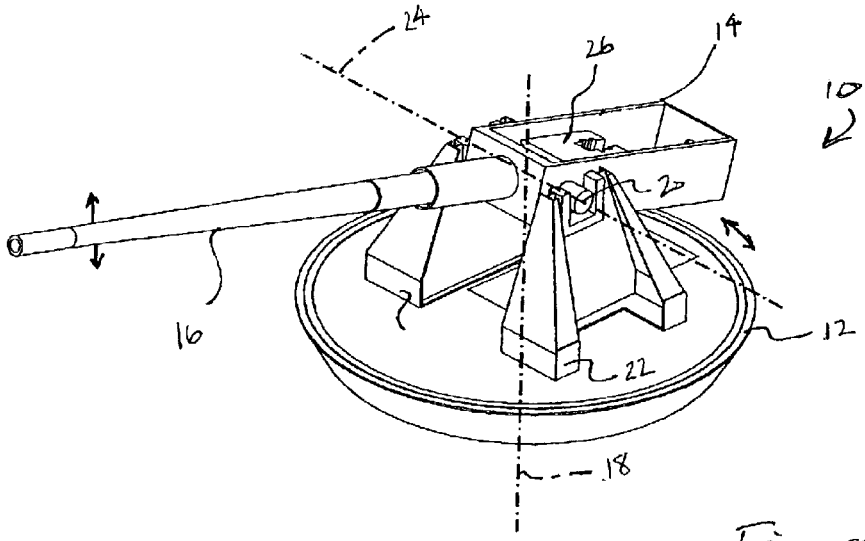
FIG. 1 is a simplified view of a weapon.
Figure 2:
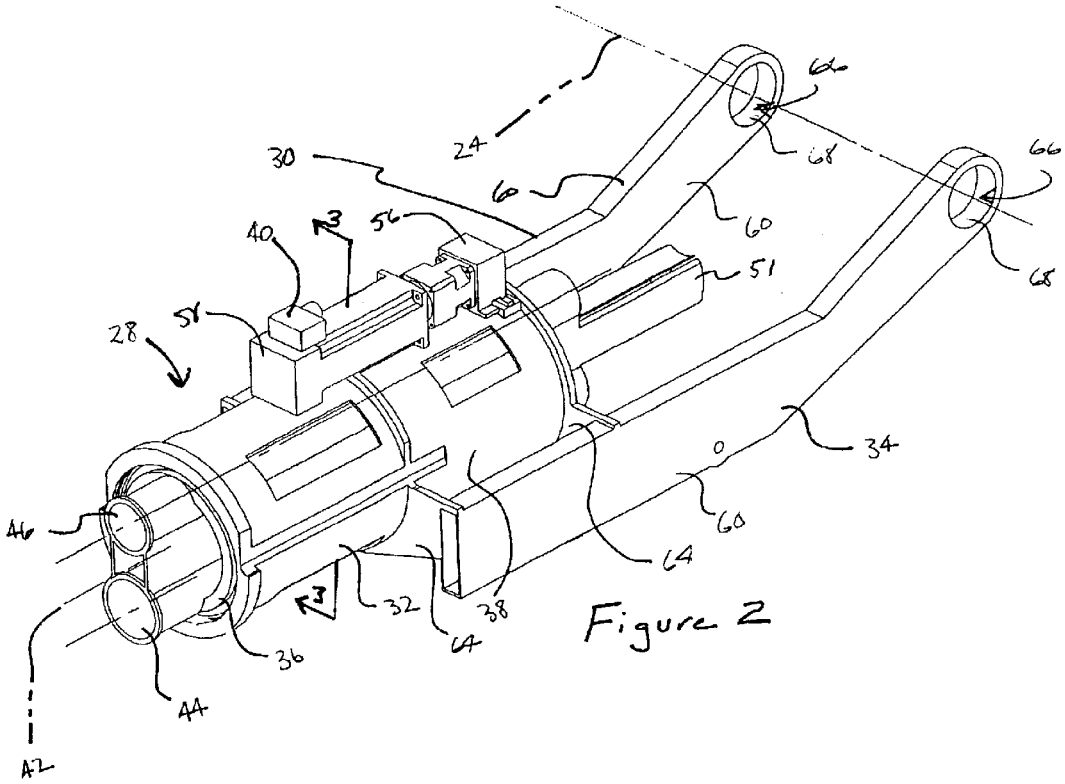
FIG. 2 is a perspective view of an ammunition cradle according to the present invention.
Figure 3:
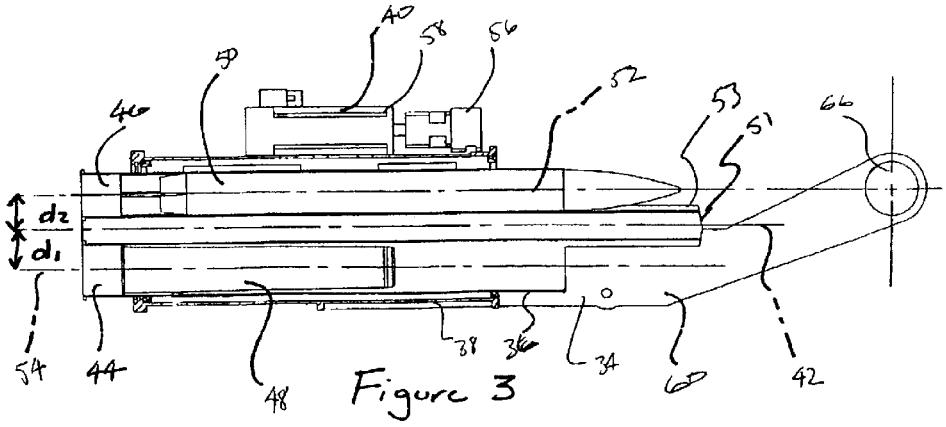
FIG. 3 is a sectional view taken along line 3—3 of FIG. 2.

FIG. 1 depicts a weapon 10. The weapon generally includes carriage 12, elevating structure 14, and barrel 16. Carriage 12 is rotatable about train axis 18, enabling the weapon to be oriented at any desired azimuth angle. Elevating structure 14 is pivotably mounted through trunnions 20 to supports 22, which in turn are fixed to carriage 12. Trunnions 20 enable elevating structure 14 and the attached barrel 16 to pivot about elevation axis 24, enabling the weapon to be elevated to any desired elevation angle. Elevating structure 14 has breech portion 26, located immediately behind barrel 16.

An embodiment of the ammunition loading system 28 of the present invention is depicted in FIGS. 2–7. Cradle assembly 30 generally includes carrier 32 and positioning assembly 34. Carrier assembly 32 generally includes rotor 36, which is rotatably disposed in housing 38, and drive assembly 40. Rotor 36 rotates about rotor axis 42, and has cells 44, 46, each adapted to receive an ammunition round component 48, 50. Guide portion 51 is provided at the distal end 53 of rotor 36. In the embodiment depicted, which is adapted for handling semi-fixed fixed ammunition, cell 44 is adapted to receive a primer/propellant cartridge component 48 and cell 46 is adapted to receive a smaller diameter projectile component 50. It will be appreciated that cells 44, 46 may also be identically sized in an alternative embodiment of the invention for handling fixed ammunition rounds. In either embodiment, distances dl and d2, which are the distances between rotor axis 42 and ammunition cell axes 52, 54, respectively, must be identical for proper operation of the invention.

Drive assembly 40 generally includes motor 58 and gear drive 56. Motor 58 is arranged to directly drive gear drive 56, which in turn, is coupled to rotor 36. Thus, motor 58 is arranged to rotate rotor 36 within housing 38. It is preferred that motor 58 be suitably controllable so as to allow rotor 36 to be positioned at any desired angular orientation within housing 38. Although an electronic "stepper" motor is a suitable motor type and is preferred, any other electric or hydraulic motor having the requisite degree of controllability may also be used for motor 58.

Positioning assembly 34 generally includes arms 60 and drive 62. Housing 38 is mounted to each arm 60 by web members 64. Each arm 60 has an aperture 66 formed therethrough, which is dimensioned to receive trunnion 20. Bearing surface 68 within each aperture 66 bears on the exterior surface of trunnion 20, and enables positioning assembly 34 to pivot about elevation axis 24. Although two arms 60 are depicted, positioning assembly 34 may also include any other suitable arrangement for pivotably mounting housing 38 about elevation axis 24.

Drive 62 is attached to arm 60, and includes a driving element, such as a suitably sized, reversible electric or hydraulic motor, frictionally or mechanically engaged with trunnion 20. Power applied to drive 62 causes positioning assembly 34 to rotate upward or downward about elevation axis 24.

One or more ammunition hoists 72 are employed to bring ammunition components such as primer/propellant cartridge component 48 and projectile component 50 to the weapon from a magazine or other storage area located below. As depicted, it is currently most preferred that two ammunition hoists 72 be provided; one for each of cells 44, 46. Any number of ammunition hoists may be employed, however.

Figure 4:
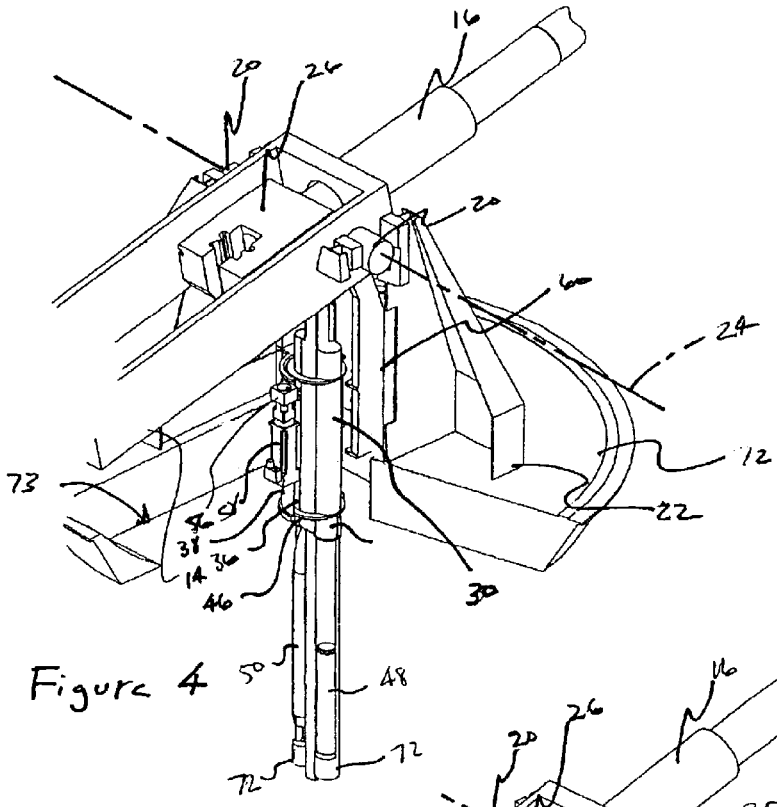
FIG. 4 is a perspective, partial section view of the cradle depicted in conjunction with a weapon, with the cradle depicted in the charging position.

Cradle assembly 30 may be selectively disposed in each of two positions. In the first position, referred to as the charging position, cradle assembly 30 is pivoted downward from elevating structure 14, through carriage aperture 73, as depicted in FIG. 4. With cradle assembly 30 in this position, rotor 36 may be positioned, using motor 58, so that each of cells 44, 46 is aligned with one of ammunition hoists 72. In the second position, referred to as the loading position and depicted best in FIG. 7, cradle assembly 30 is pivoted upward within elevating structure 14. In this position, rotor 36 may be positioned, using motor 58, so that each of cells 44, 46 are selectively aligned in sequence with breech portion 26 and barrel 16.

Any suitable known mechanical or electronic control system may be used for determining the position of rotor 36 and cells 44, 46 relative to ammunition hoists 72 and breech portion 26, and to provide appropriate positioning signals to motor 58.

Figure 5:
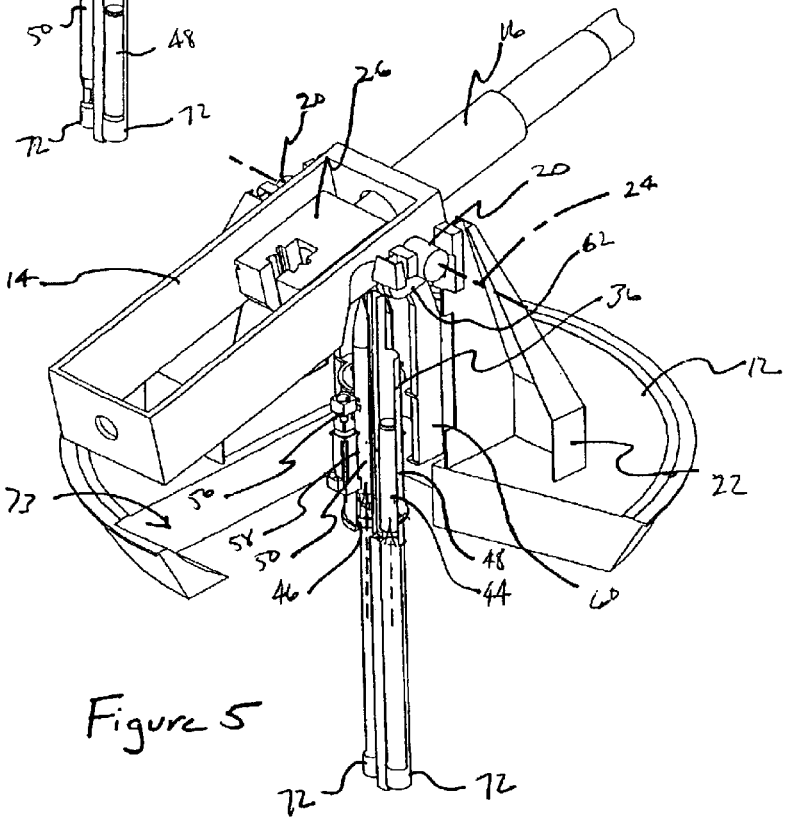
FIG. 5 is similar to FIG. 4, but with portions of the cradle cut-away to depict the positions of ammunition pieces within the cradle.
Figure 6:
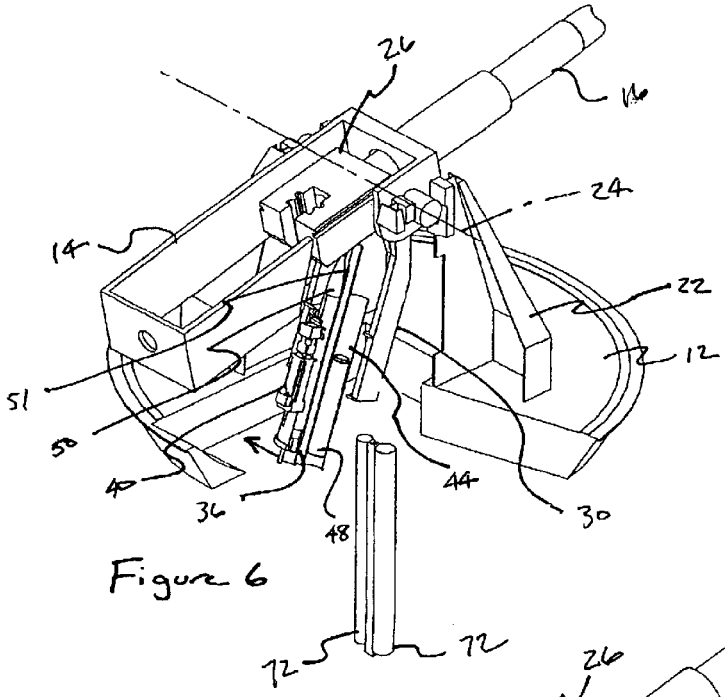
FIG. 6 is similar to FIG. 5, but with the cradle in motion between the charging position and the loading position.
Figure 7:
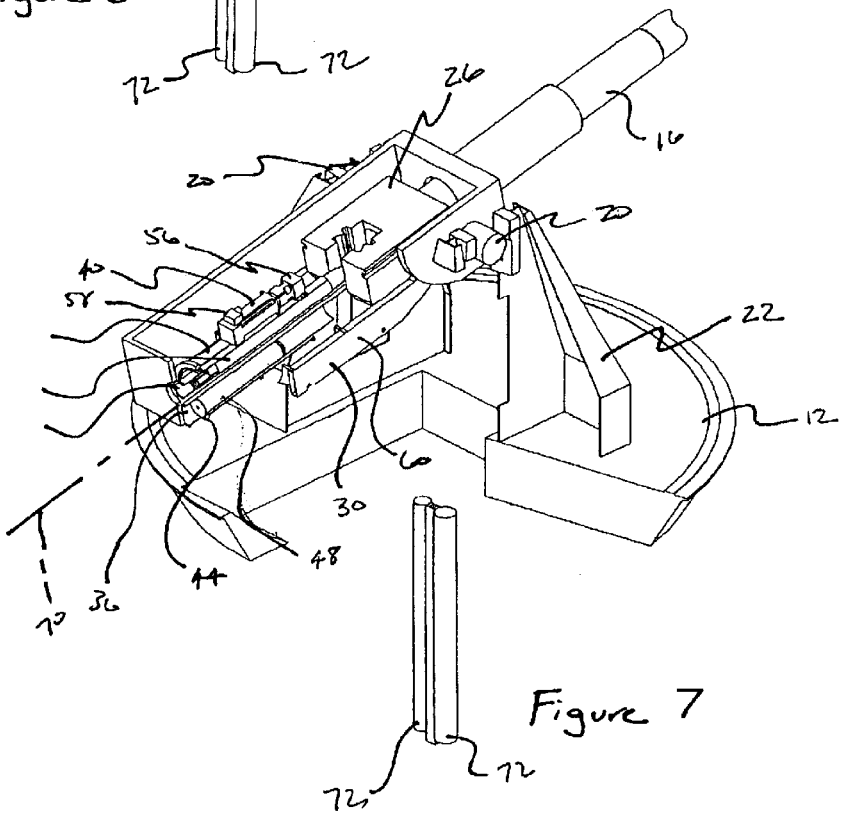
FIG. 7 is similar to FIG. 6, but with the cradle in the loading position.

The operation of ammunition loading system 28 may be understood with reference to FIGS. 4–7. When cradle assembly 30 is positioned in the charging position as depicted in FIGS. 4 and 5, rotor 36 is rotated, using motor 58, so that ammunition cells 44, 46 are aligned with ammunition hoists 72. Once the cells are aligned, cradle assembly 30 is charged by hoisting a primer/propellant cartridge component 48 upward into cell 44, and hoisting a projectile component 50 into cell 46. After charging is complete, cradle assembly 30 is pivoted upward about elevation axis 24 as depicted in FIG. 6, until the loading position is reached as depicted in FIG. 7. Barrel 16 presents a loading axis 70. In this position, rotor 36 is rotated, using motor 58, until cell 46 is aligned with breech portion 26 and barrel 16 along loading axis 70. The projectile component 50 is rammed forward from cell 46, along guide portion 51, and into the breech portion 26. Rotor 36 is then rotated using motor 58 so that cell 44 is aligned with breech portion 26 and barrel 16 along loading axis 70. Primer/propellant cartridge component 48 is then rammed forward along guide portion 51 into breech portion 26. Cradle assembly 30 may then be swung downward through carriage aperture 73, and cells 44, 46, aligned with ammunition hoists 72 to receive another round, while breech portion 26 is closed and the weapon fired.

Although cradle assembly 30 may have two ammunition cells as illustrated herein in FIGS. 2–7, it will be appreciated that any desired number of ammunition cells, within available space constraints, may be provided in the cradle and are within the scope of the present invention. Thus, for example, a four cell cradle may permit four fixed ammunition rounds or two semi-fixed rounds to be transferred in a single charging/loading cycle. In addition, those of skill in the art will appreciate that other configurations of a multiple cell cradle are possible and are within the scope of the invention.

Figure 8:
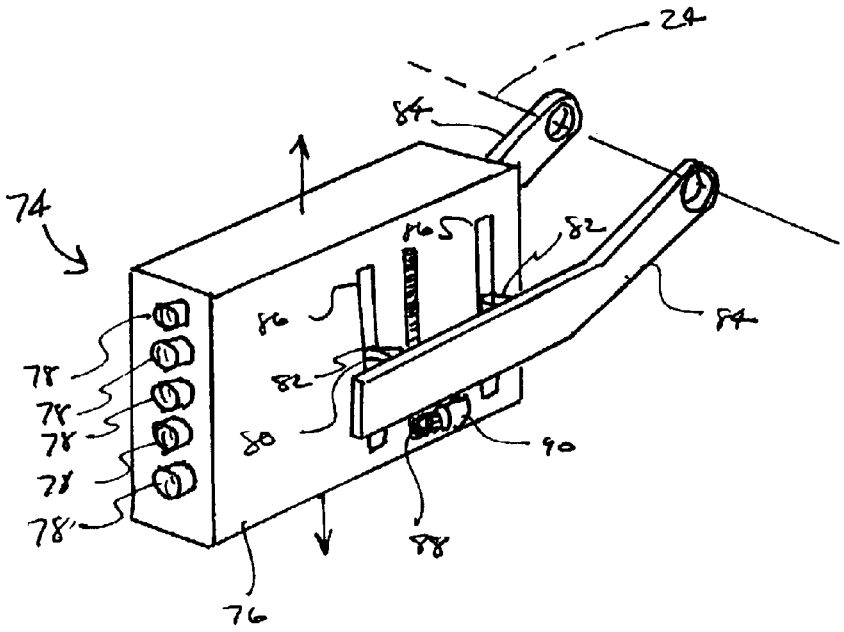
FIG. 8 is a perspective view of an embodiment of a linear sliding multiple cell ammunition cradle according to the present invention.

For example, FIG. 8 depicts an embodiment of a multiple cell cradle 74 using a sliding arrangement for cell alignment. As before, the assembly is pivotably mounted about elevation axis 24, allowing the cradle to be positioned in a charging position and a loading position. In this embodiment, however, carrier 76 contains a plurality of ammunition cells 78 arranged in a linear fashion. Slide mechanism 80, includes guides 82 which extend from arms 84 and engage slots 86 in carrier 76. Guides 82 serve to retain carrier 76 between arms 84, while allowing it to slide vertically as depicted. Ammunition cells 78 may thus be selectively aligned with an ammunition hoist when in the cradle is in the charging position, and with the breech and barrel when in the loading position. To allow controllable, selective positioning of the cradle 76, rack and pinion assembly 88, driven by motor 90 is provided.

Although weapon 10 is depicted here as a major caliber gun, it is contemplated that the present invention may be usable with all types of weapons. For example, barrel 16 may be a barrel as shown, a torpedo tube, a rocket launcher cell and rail assembly, or any other type of element having a similar function. Thus, in a weapon wherein such other type of element is used to fire, guide or launch a munition, missile, projectile, bomb, or other weapon, such element shall be deemed to define a barrel.

The present invention enables multiple ammunition components or multiple complete rounds to be transferred from vertical ammunition hoists into a position where they may be loaded into the weapon with a single, simple swing motion of the cradle. This relatively simple cradle motion coupled with multiple ammunition cells, enables more uniform and rapid ammunition transfer and a correspondingly improved rate of fire when compared with known on-axis loading systems. Also, the rate of fire is independent of the relative azimuth of the weapon. It is anticipated that rates of fire of 10 or more rounds per minute are achievable with the present invention.

With suitable apparatus to arrange ammunition components as they are placed in the ammunition hoists, or with separate ammunition hoists, the ammunition transfer system of the present invention may be used to handle any type of ammunition, whether fixed, semi-fixed or separate. The ammunition transfer system may also be especially suited to handling increased length rocket-propelled and precision-guided munitions by appropriately adjusting the length of the ammunition cells and the related positioning of the ammunition hoists, cradle arms and weapon breech.

Although the description above contains many specificities, these should not be construed as limiting the scope of the invention but as merely providing illustrations of some of the presently preferred embodiments of the invention. Thus, the scope of the invention should be determined by the appended claims and their legal equivalents, rather than by the examples given.

What is claimed is:

1. A multiple cell ammunition cradle system for a weapon, the weapon having a carriage and a barrel, the system comprising:

a plurality of ammunition hoists; and a cradle operably coupled to the carriage and selectively positionable in a charging position and a loading position, the cradle having a rotor with a plurality of cells, said rotor being rotatable about a rotor axis, each cell adapted to receive an ammunition component, said rotor being controllably positionable so that each of said plurality of cells is selectively alignable with at least one of said plurality of ammunition hoists when said cradle is positioned in the charging position and so that each cell is selectively alignable with said barrel when said cradle is positioned in said loading position.

2. The multiple cell ammunition cradle system of claim 1, wherein said rotor is positionable so that more than one of said plurality of ammunition cells is simultaneously aligned with a separate one of said plurality of ammunition hoists.

3. The multiple cell ammunition cradle system of claim 1, wherein said ammunition component is a fixed ammunition round.

4. The multiple cell ammunition cradle system of claim 1, wherein said rotor has two cells, one of said cells being adapted to receive a primer/propellant cartridge, and the other of said cells being adapted to receive a projectile.

5. A multiple cell ammunition cradle system for a weapon, the weapon having a barrel for receiving an ammunition component, the system comprising:

a plurality of ammunition hoists; and a cradle having a carrier with a plurality of cells, said cradle being controllably positionable in a charging position and a loading position, said carrier being arranged so that each cell is alignable with at least one of said plurality of ammunition hoists for receiving the ammunition component when said cradle is in the charging position and each cell is alignable with the barrel for transferring the ammunition component for loading into the weapon when said cradle is in the loading position.

6. The multiple cell ammunition cradle system of claim 5, wherein more than one of said plurality of cells is alignable with a separate one of said plurality of ammunition hoists.

7. The multiple cell ammunition cradle system of claim 5, wherein said ammunition component is a fixed ammunition round.

8. The multiple cell ammunition cradle system of claim 5, wherein said carrier has two cells, one of said cells being adapted to receive a primer/propellant cartridge, and the other of said cells being adapted to receive a projectile.

9. The multiple cell ammunition cradle system of claim 5, wherein said weapon has an elevating structure pivotable about an elevation axis, and wherein said cradle is pivotable about a pivot axis oriented substantially parallel with said elevation axis.

10. A multiple cell ammunition cradle system for a weapon, the weapon having a barrel and a carriage, the system comprising:

a plurality of ammunition hoists;

a cradle operably coupled to said carriage and having a plurality of cells, each cell adapted to receive an ammunition component; and means for selectively aligning each of said cells with (a) at least one of said plurality of ammunition hoists to receive an ammunition component; and (b) said barrel to load the ammunition component into said weapon.

11. The multiple cell ammunition cradle system of claim 10, wherein said means for selectively aligning each of said cells comprises a rotor disposed in said cradle, said rotor connecting said plurality of cells and being rotatable about a rotor axis.

12. The multiple cell ammunition cradle system of claim 11, wherein said rotor is power actuated.

13. The multiple cell ammunition cradle system of claim 10, wherein said ammunition component is a fixed ammunition round.

14. The multiple cell ammunition cradle system of claim 10, wherein said cradle has two cells, one of said cells being adapted to receive a primer/propellant cartridge, and the other of said cells being adapted to receive a projectile.

15. A method for sequentially loading a weapon having a barrel presenting a loading axis, said weapon being on a carriage, the method comprising the steps of:

providing a multiple cell ammunition cradle system comprising a plurality of ammunition hoists and a cradle operably coupled to the carriage, the cradle having a rotor with a plurality of cells, each cell adapted to receive an ammunition component, said rotor being controllably positionable so that each cell is selectively alignable with at least one ammunition hoist to receive the ammunition component and each cell is selectively alignable with said barrel to load the ammunition component into the barrel;

loading an ammunition component into each of said plurality of cells from said plurality of ammunition hoists;

positioning the cradle so that said cradle is disposed along said loading axis;

rotating and positioning the rotor so that one of said plurality of cells is axially aligned with said barrel; and ramming the ammunition component from the aligned ammunition cell into the barrel.

16. An ammunition cradle assembly for transferring ammunition components from an ammunition hoist to a weapon, the weapon having a carriage and a barrel, the assembly comprising:

at least one cradle arm pivotably mounted to said carriage, said at least one cradle arm being positionable so that the cradle assembly may be alternately oriented in a charging position and a loading position;

a carrier attached to said at least one cradle arm, said carrier having a plurality of cells adapted to receive an ammunition component; and means for selectively aligning each of said plurality of cells with the ammunition hoist when said cradle assembly is oriented in the charging position and for selectively aligning each cell with said barrel when said cradle assembly is oriented in said loading position.

17. The ammunition cradle assembly of claim 16, wherein said means for selectively aligning each of said plurality of cells with the ammunition hoist when said cradle assembly is oriented in the charging position and for selectively aligning each cell with said barrel when said cradle assembly is oriented in said loading position comprises a rotor rotatably mounted in said carrier, said ammunition cells being formed in said rotor.

18. The ammunition cradle assembly of claim 16, wherein said ammunition cells are linearly arranged in said carrier, and wherein said means for selectively aligning each of said plurality of cells with the ammunition hoist when said cradle assembly is oriented in the charging position and for selectively aligning each cell with said barrel when said cradle assembly is oriented in said loading position comprises a slide mechanism slidably attaching said carrier to said at least one cradle arm.

19. The multiple cell ammunition cradle system of claim 16, wherein said carrier has two cells, one of said cells being adapted to receive a primer/propellant cartridge, and the other of said cells being adapted to receive a projectile.

20. A weapon and ammunition loading system comprising:

a barrel;

a carriage operably coupled to said barrel, said carriage adapted to azimuthally orient said barrel;

at least one ammunition hoist for supplying ammunition rounds;

a cradle alternately positionable in a charging position and a loading position, said cradle having a carrier with a plurality of cells, each cell being selectively alignable with said at least one ammunition hoist to receive an ammunition round from said ammunition hoist when said cradle is in the charging position and selectively alignable with said barrel to transfer the ammunition round to said barrel when said cradle is in the loading position; and a positioning assembly for alternately positioning said cradle in the charging position and the loading position, said positioning assembly adapted to move said cradle between said charging position and said loading position at a rate independent of the azimuthal orientation of said barrel.

21. The weapon and ammunition loading system of claim 20, wherein the system has a plurality of ammunition hoists.

22. The weapon and ammunition loading system of claim 21, wherein each of said plurality of cells is selectively alignable with a separate one of said plurality of ammunition hoists.

* * * * *

UNITED STATES PATENT AND TRADEMARK OFFICE

CERTIFICATE OF CORRECTION

PATENT NO. : 6,752,063 B2
DATED : June 22, 2004
INVENTOR(S) : Panek et al.

It is certified that error appears in the above-identified patent and that said Letters Patent is hereby corrected as shown below:

Column 2,
Line 4, "Firing" should be lowercase.
Line 11, delete "arc" and insert -- are --.
Line 29, delete "modem" and insert -- modern --.

Column 3,
Line 62, after "2;" begin a new paragraph.
Line 66, after "cut" delete "-".

Column 4,
Line 31, delete the second occurrence of "fixed".
Line 37, delete "d1" and insert -- d1 --.

Column 6,
Line 2, after "80" delete ";".
Line 6, after "when" delete "in".
Line 10, after "90", insert -- , --.

Signed and Sealed this

Tenth Day of May, 2005

JON W. DUDAS
*Director of the United States Patent and Trademark Office*